United States Patent [19]

Mills

[11] Patent Number: 4,724,622

[45] Date of Patent: Feb. 16, 1988

[54] NON-SLIP OUTSOLE

[75] Inventor: John D. Mills, East Grand Rapids, Mich.

[73] Assignee: Wolverine World Wide, Inc., Rockford, Mich.

[21] Appl. No.: 888,698

[22] Filed: Jul. 24, 1986

[51] Int. Cl.[4] ..... A43B 13/04

[52] U.S. Cl. ..... 36/30 R; 36/32 R

[58] Field of Search ..... 36/32 R, 25 R, 30 R, 36/31, 32 A, 15, 19.5, 59 R, 59 C, 28; 12/142 RS, 142 T; D2/320

[56] References Cited

U.S. PATENT DOCUMENTS

| | | | |
|---|---|---|---|
| 1,650,466 | 11/1927 | Righter | 36/32 R |
| 3,327,334 | 6/1967 | Wilmanns et al. | 36/32 R |
| 3,444,572 | 5/1969 | Broughton | 36/32 R |
| 3,824,716 | 7/1974 | Di Paolo | 36/30 R |
| 3,875,689 | 4/1975 | Frautomas | 36/32 R |

FOREIGN PATENT DOCUMENTS

| | | | |
|---|---|---|---|
| 831962 | 2/1952 | Fed. Rep. of Germany | 36/32 R |
| 1016468 | 11/1952 | France | 36/30 R |
| 499735 | 11/1954 | Italy | 36/30 R |
| 8303528 | 10/1983 | PCT Int'l Appl. | 36/30 R |
| 8304166 | 12/1983 | PCT Int'l Appl. | 36/115 |
| 820 | of 1858 | United Kingdom | 36/25 R |
| 11641 | of 1913 | United Kingdom | 36/30 R |

*Primary Examiner*—Steven N. Meyers

*Attorney, Agent, or Firm*—Price, Heneveld, Cooper, DeWitt & Litton

[57] ABSTRACT

A shoe outsole assembly having a separate tread insert received by and bonded within a downwardly open sole cavity defined by a peripheral wall, and protruding downwardly from the cavity beyond the peripheral wall to form a ground and floor engaging member, the bottom of the insert being substantially flush with the peripheral wall at the termini of the toe and heel of the outsole.

2 Claims, 5 Drawing Figures

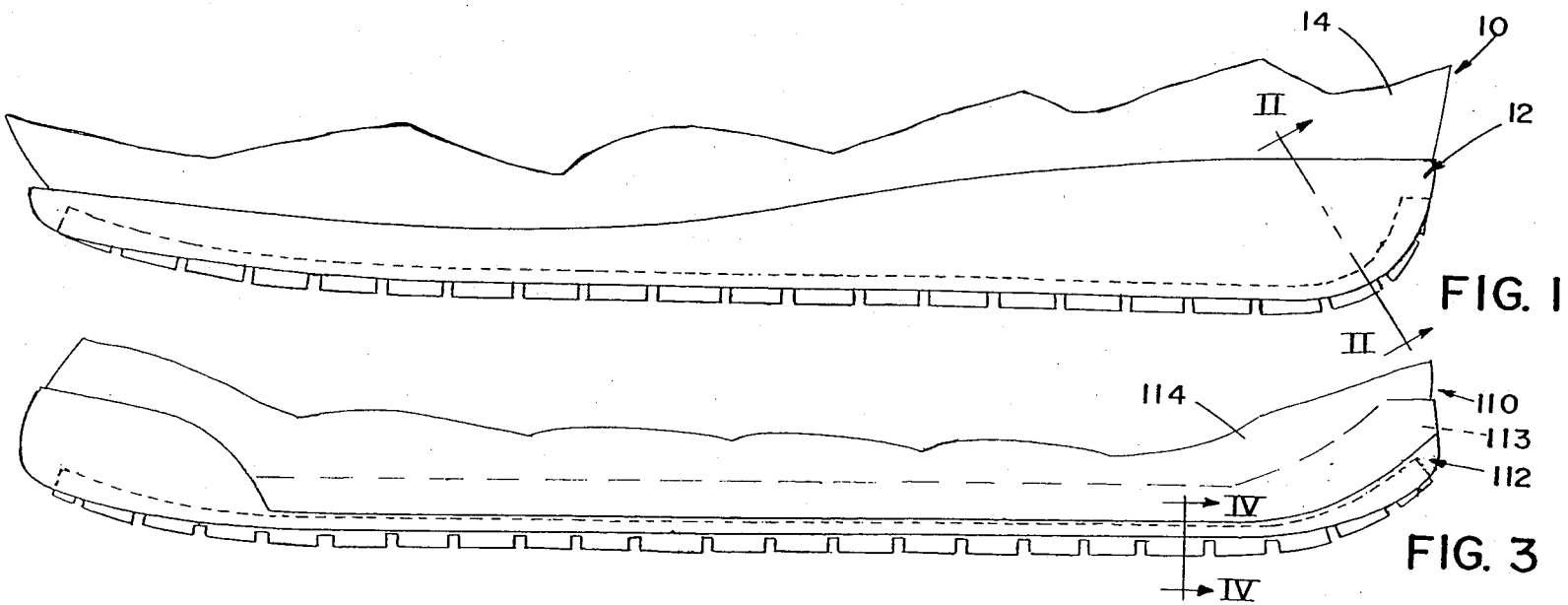
FIG. 1
FIG. 3
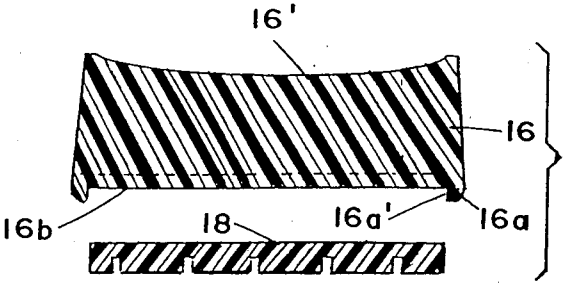
FIG. 2
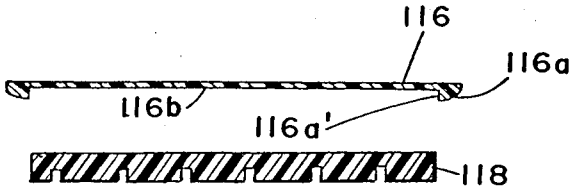
FIG. 4

NON-SLIP OUTSOLE

BACKGROUND OF THE INVENTION

Shoes used for different activities have different friction, slippage and maneuverability requirements. Thus, shoes for dancing, or shoes for football and other sports played on grass, have different requirements than shoes for basketball and other sports played on floor surfaces or shoes for working on wet slippery floors, e.g., in a restaurant kitchen. The present shoe sole assembly was developed in connection with activities where slip resistance is important, e.g., in restaurant kitchens, especially where the floor may be wet. Applicant experimented with a sole tread which exhibited such outstanding slip resistance that the cemented tread actually broke loose and became detached from the shoes during testing. The inventor herein then developed a novel shoe sole assembly preventing sole detachment of a high slip resistance tread from the shoe. The development is especially useful for restaurant work shoes with tremendous slip resistance, and alternatively is useful for athletic shoes where high slip resistance is advantageous.

SUMMARY OF THE INVENTION

The invention provides a unique shoe sole assembly enabling use of a particularly high slip resistance tread as for work shoes used in restaurants or the like, or alternatively athletic shoes, where stress would tend to break the tread loose from the sole. An important object of this invention is to provide a sole assembly which resists the tendency of the tread to become detached from the shoe. A tread layer is specially interfitted in a bottom cavity of the sole for bonding of the periphery as well as the upper surface to the tread layer. The tread layer is recessed up into the sole but caused to protrude downwardly therefrom a small amount for floor engagement except at the termini of the toe and heel regions. These regions, where the detachment stress is maximum, are specially protected by having the terminal tread surface flush with the peripheral sole wall.

These and other features, objects and advantages of the invention will become apparent upon studying the following specification in conjunction with the drawings.

BRIEF DESCRIPTION OF THE DRAWINGS

FIG. 1 is a side elevational view of a work shoe employing the novel sole assembly;

FIG. 2 is an exploded sectional view taken on plane II—II of FIG. 1;

FIG. 3 is a side elevational view of an athletic shoe employing the novel sole assembly;

FIG. 4 is an exploded sectional view taken on plane IV—IV of FIG. 3.

DESCRIPTION OF THE PREFERRED EMBODIMENTS

Figure 5:
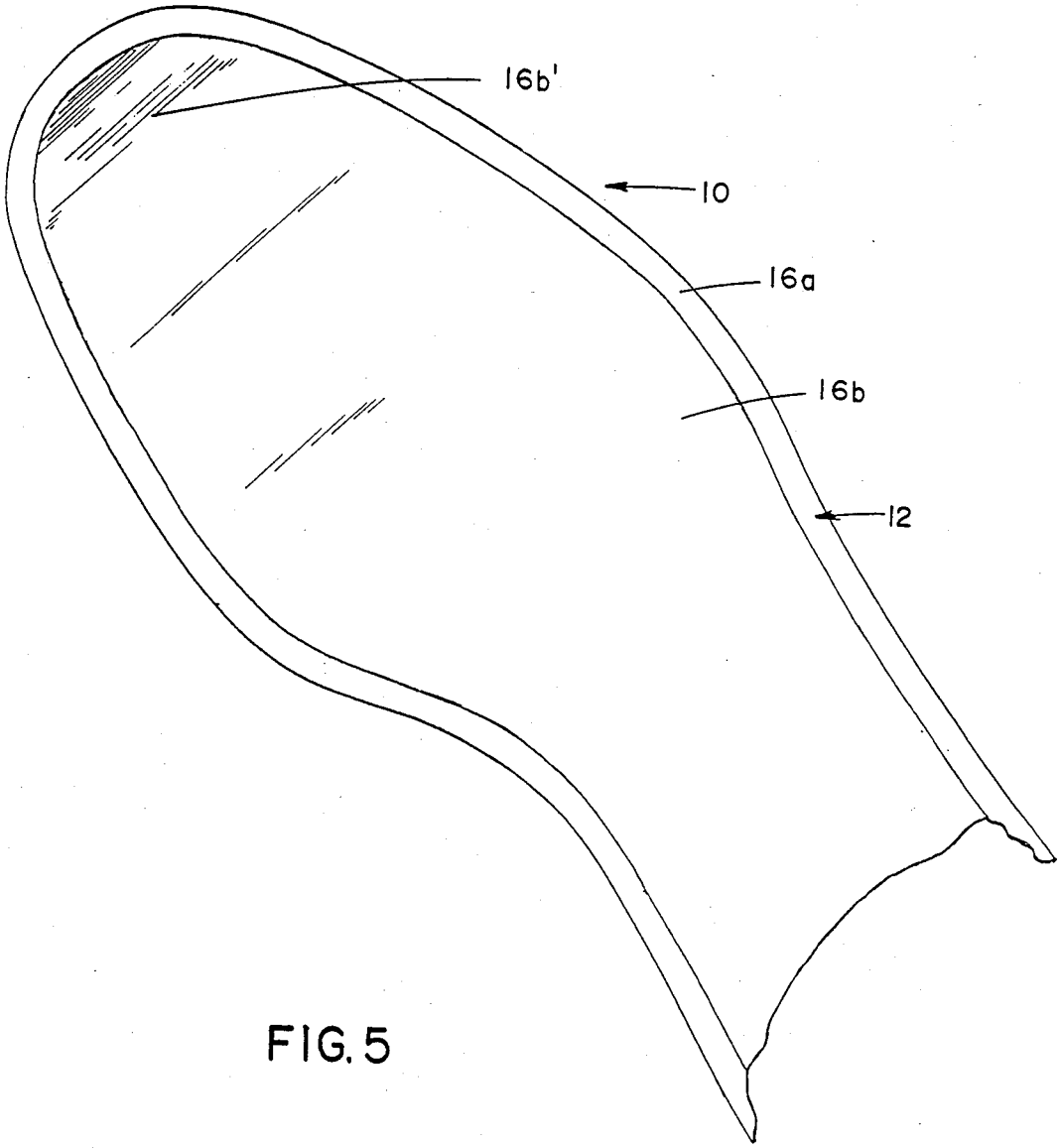
FIG. 5 is a bottom fragmentary view of the shoe sole of FIGS. 1 and 2, without the tread insert therein.

Referring now to FIGS. 1 and 2, the work shoe 10 there set forth includes a sole assembly 12 and a shoe upper 14. The upper may be of any chosen type and therefore is not shown or described in detail. Sole assembly 12 as there depicted includes an outsole 16 and tread insert layer 18.

Outsole 16 is formed of a polymer such as polyurethane, having a top surface 16', preferably configurated to conform to a user's foot, and on which an inner sole (not shown) may be mounted after the shoe upper is secured as by adhesion to sole 16. The securement of the upper to the shoe sole, and the employment of various types of inner soles or the like is conventional technology and therefore will not be described in detail herein.

The bottom of sole 16 has a peripheral downwardly projecting wall **16*a* which extends around the entire periphery of sole 16 to define a downwardly open cavity 16*b* extending over substantially the entire sole bottom. This downwardly facing cavity may vary somewhat in depth on different style shoes, but on a typical work shoe is approximately 2.5 millimeters deep over its extent, except that at the termini of the toe and heel regions the depth is increased to about 5 millimeters, i.e., about double the depth at the other portions of the cavity. In other words, cavity 16*b* has first and second depths, with the second depth at the termini of the heel and toe regions being greater than the first depth of the remaining portions of cavity 16*b***.

In the embodiment shown in FIGS. 1 and 2, the tread layer 18 has a uniform thickness over its extent, has a peripheral dimension and configuration matching that of the inside wall **16*a'* of cavity 16*b*, and has a total thickness of approximately twice that of the 2.5 millimeter depth of most of cavity 16*b* but substantially equal to the increased depth at the toe and heel regions 16*b'* of the cavity. Thus, when tread insert layer 18 is fitted into the cavity, the terminal portions of layer 18 are substantially flush with the outer edge of wall 16*a* as shown in FIG. 1. This tread layer insert is cemented or bonded with a typical rubber cement or the like at the upper surface of tread layer 18 to the upper surface of the cavity 16*b*, as well as between the peripheral edge of layer 18 and wall surface 16*a'* of cavity 16*b***. This combination peripheral bonding, as well as upper surface bonding, plus the recession of the tread ends at the toe and heel regions to avoid torsional stress tending to break the toe or heel loose, has proven to be highly effective in preventing detachment of the tread from the shoe, in spite of the unusually high slip resistance characteristic of the bottom tread surface. Except at the heel and toe ends, this tread surface protrudes slightly, i.e., about 2.5 millimeters, from the bottom of most of the shoe sole.

Conceivably, the flush interfit at the toe and heel regions could be achieved by having tread layer 18 tapered to a thinner dimension at these regions in addition to, or alternatively with, the cavity being of greater depth at these regions.

In FIGS. 3 and 4 is depicted an athletic shoe 110 as an alternative embodiment. This athletic shoe includes an upper 114, an outsole assembly 112 and a midsole 113. The outsole is molded to be integral with the midsole. The outsole includes a main sole member 116 having a lower peripheral wall **116*a* which defines therewithin a cavity 116*b* for receiving the tread insert layer 118. As with the first embodiment, the tread layer 118 is of a vertical thickness greater than the depth of the cavity over most of the extent of the shoe bottom so as to protrude slightly therefrom, e.g., about 2.5 to 3 millimeters. At the ends of the toe and heel regions, the cavity has a greater depth so that the lower tread surface is flush with, or protrudes a very slight amount, i.e., substantially flush with the adjacent bottom edge surface of peripheral wall 116*a*. Here again, the peripheral edge of insert 118 is cemented or bonded as with a rubber cement to the inside peripheral wall 116***a'* around the cavity 116*b*, as well as the upper surface of insert 118 being bonded to the upper surface of the cavity.

Conceivably certain minor variations in this construction may be made without departing from the inventive concept. Hence, the invention is intended to be limited only by the scope of the appended claims and the reasonably equivalent structures to those defined therein.

The embodiments of the invention in which an exclusive property or privilege is claimed are defined as follows:

1. A slip resistant shoe sole assembly comprising:

a shoe sole having a peripheral downwardly extending wall having a lower edge and defining a downwardly open cavity within said wall;

said cavity having an upper surface and a peripheral wall surface;

a tread insert layer having a peripheral edge with a configuration and size matching that of said peripheral wall surface, having an upper bonding surface, and having a lower slip resistant tread surface;

said tread insert layer having a sheet-like construction with uniform thickness throughout, wherein said peripheral edge is formed generally perpendicular to said upper and lower surfaces thereof, and being fitted within said cavity with said upper insert surface bonded to said upper cavity surface, and said insert peripheral edge bonded to said peripheral wall;

said shoe sole assembly having heel and toe regions;

said cavity having a first depth less than the thickness of the tread insert layer and a second greater depth at the termini of said heel and toe regions, which second depth is equal to the thickness of said tread insert layer, whereby said tread insert lyaer at the termini of said heel and toe regions is flush with said peripheral wall lower edge at said heel and toe regions to thereby avoid torsional stress on said tread insert layer tending to break away the heel or toe region of said insert layer loose from said shoe sole assembly, and the remaining regions of said tread insert layer having a thickness greater than the depth of said cavity, to protrude downwardly beyond said cavity for slip resistant floor engagement.

2. The shoe outsole assembly in claim 1, wherein said tread insert extends over the sole bottom, with said lower tread surface forming the floor engaging surface.

* * * * *